United States Patent [19]

Kamei et al.

[11] Patent Number: 4,909,316

[45] Date of Patent: Mar. 20, 1990

[54] DUAL-TUBE HEAT PIPE TYPE HEAT EXCHANGER

[75] Inventors: Mitsuru Kamei; Takao Sakai, both of Mito; Shinichi Sugihara, Tokyo; Motoharu Yatsuhashi, Funabashi; Ryuichi Okiai, Yotsukaido; Masataka Mochizuki, Nagareyama, all of Japan

[73] Assignees: Doryokuro Kakunenryo Kaihatsu Jigyodan; Fujikura Ltd., both of Tokyo, Japan

[21] Appl. No.: 266,771

[22] Filed: Nov. 3, 1988

[30] Foreign Application Priority Data

Dec. 24, 1987 [JP] Japan ..... 62-196486[U]

[51] Int. Cl.[4] ..... F28D 15/02

[52] U.S. Cl. ..... 165/104.26; 165/70; 165/104.14; 122/33; 376/367

[58] Field of Search ..... 165/104.21, 104.26, 165/70, 104.14; 122/366, 33; 126/433

[56] References Cited

U.S. PATENT DOCUMENTS

| | | | |
|---|---|---|---|
| 1,690,108 | 11/1928 | Grady | 165/104.21 |
| 4,279,294 | 7/1981 | Fitzpatrick et al. | 165/104.26 |
| 4,560,533 | 12/1985 | Huebotter et al. | 165/70 |

FOREIGN PATENT DOCUMENTS

| | | | |
|---|---|---|---|
| 235688 | 10/1986 | Japan | 165/104.19 |

*Primary Examiner*—Albert W. Davis, Jr.

*Attorney, Agent, or Firm*—Oblon, Spivak, McClelland, Maier & Neustadt

[57] ABSTRACT

Herein disclosed is a dual-tube heat pipe type heat exchanger comprising a heat pipe confined with a working fluid for transferring a heat as a latent heat by repeating evaporations and condensations. The heat pipe includes an outer tube which is disposed within a hot fluid such that its axis is generally horizontal. Further included is an inner tube which is inserted in the outer tube and radially offset upward to substantially contact with the top portion of the inner face of the outer tube and to confine a space between the inner circumference of the outer tube and the outer circumference of the inner tube, thus forming the heat pipe.

5 Claims, 1 Drawing Sheet

DUAL-TUBE HEAT PIPE TYPE HEAT EXCHANGER

BACKGROUND OF THE INVENTION

The present invention relates to a heat exchanger having a heat pipe formed of a space between an outer tube and an inner tube inserted in the outer tube and, more particularly, to a heat exchanger for exchanging heat between a hot fluid flowing around the outer circumference of the outer tube and a cold fluid flowing in the inner tube.

In a known heat exchanger using a heat pipe, this pipe is interposed between a hot fluid passage and a cold fluid passage. The heat exchanger of this type is advantageous in that the heat pipe can effect the heat exchange highly efficiently because it transfers the heat as the latent heat of a working fluid confined therein, and in that the heat exchange is not troubled in the least even if the hot fluid passage and the cold fluid passage are disposed apart from each other because the heat pipe can transfer the heat over a long distance through evaporation and flows of the working fluid. Despite of these advantages, however, the heat exchanger must have its heat pipe exposed at its one end to the hot fluid and its other to the cold fluid. In order to retain a wide heat transfer area, therefore, it is necessary to enlarge the heat pipe in length and diameter. This necessity raises a disadvantage that the heat exchanger is large-sized in its entirety.

In order to avoid this disadvantage, there has been proposed a heat pile which has a dual-tube structure. In this structure, an inner tube is inserted in an outer tube to form a sealed space between the inner circumference of the outer tube and the outer circumference of the inner tube. This space is evacuated and then confined with a condensible fluid such as water as its working fluid.

A radiator using the dual-tube heat pipe is disclosed in the specification of Japanese Patent Laid-Open No. 56 - 27891 or on page 116 of "Heat Pipe and its Applications" (published by OHM K.K.), for example. This radiator is constructed such that the inner tube for a hot fluid is so inserted with a lower eccentricity in the outer tube arranged generally in a horizontal position and formed with fins on its outer circumference that it is immersed in the working fluid while forming the space between those outer and inner tubes into the heat pipe. As a result, the outer circumference of the inner tube acting as an evaporator is sufficiently fed with the working liquid by the action of a wick because the inner tube is partially immersed in the working fluid. This fluid is evaporated by the heat transferred from the hot fluid flowing in the inner tube, and its resultant vapor comes into contact with the inner circumference of the outer tube so that its heat is robbed by the external fluid at a lower temperature. In other words, the vapor releases its heat to condense into the working liquid, which then drops on the inner circumference of the outer tube to form a liquid sump. The working liquid is fed again for reuse to the outer circumference of the inner tube by the wick action.

In the radiator of the dual-tube heat pipe type, in which the hot fluid flows in the inner tube whereas the cold fluid flows outside the outer tube, the working fluid will stagnate on the bottom of the outer tube. This stagnation makes it necessary to offset the inner tube for the hot fluid downward with respect to the outer tube so that the inner tube may be partially immersed in the working fluid. In case, on the contrary, the flows in the inner tube whereas the hot fluid flows outside of the outer tube, the working fluid is heated and evaporated, even if stagnant on the bottom of the outer tube, by the heat of the hot fluid transferred through the outer tube. The resultant vapor of the working fluid comes into contact with the outer circumference of the inner tube so that it is cooled and condensed. In connection with the heat transfer to and from the working fluid, there arises no trouble even if the outer tube and the inner tube are concentrically arranged. Therefore, the heat exchanger using the dual-tube heat pipe for exchanging the heat between the cold fluid flowing in the inner tube and the hot fluid flowing outside of the outer tube is constructed such that the inner tube is concentrically inserted in the outer tube, which is lined with a wick, as disclosed in the specification of Japanese Patent Laid-Open No. 61 - 235688, for example.

In case the heat is to be transferred from the hot fluid outside of the outer tube to the cold fluid in the inner tube by the dual-tube heat pipe having its outer and inner tubes arranged in a concentric relation, the heat pipe is arranged with a horizontal axis to cause the overall inner circumference of the outer tube to act as the evaporator. Therefore, the wick is generally extended over the inner circumference of the outer tube. In case, however, the heat exchange is to be accomplished between molten hot sodium and water, for example, the heat flow is too high for the working fluid to extend all over the inner circumference of the outer tube, even if it is scooped by the capillary action of the wick, from the liquid sump formed on the bottom of the outer tube so that it is evaporated midway. As a result, the working fluid is insufficient at the top portion of the inner circumference of the outer tube to invite the so-called "dry out". Thus, the heat pipe of the dual-tube structure having its outer and inner tubes concentrically arranged is accompanied by a problem that the substantial area of the evaporator is restricted to drop the heat exchanging efficiency in case of the heat exchange between the hot fluid flowing outside of the outer tube and the cold fluid flowing in the inner tube.

SUMMARY OF THE INVENTION

The present invention has been conceived in view of the background thus far described and has an object to provide a dual-tube heat pipe type heat exchanger which is able to improve the heat exchanging efficiency even in the case of a high heat flow by performing the heat exchange between a hot fluid flowing outside of the outer tube and a cold fluid flowing in the inner tube.

According to the present invention, there is provided a dual-tube heat pipe type heat exchanger comprising a heat pipe confined with a working fluid for transferring a heat as a latent heat by repeating evaporations and condensations, said heat pipe including: an outer tube disposed within a hot fluid with its axis being generally horizontal; and an inner tube inserted in said outer tube and radially offset upward to substantially contact with the top portion of the inner face of said outer tube and to confine a space between the inner circumference of said outer tube and the outer circumference of said inner tube thereby to form said heat pipe.

In the heat exchanger according to the present invention, the outer tube is arranged generally in a horizontal position so that the working fluid in the heat pipe is stored in the bottom of the outer tube so that it is distributed to the inner circumference of the outer tube by the capillary action of a wick, if any on the inner circumference of the outer tube. The heat of the hot fluid is transferred to the working fluid from the outside of the outer tube. As a result, the working fluid is evaporated to come into contact with the inner tube for the cold fluid, which is arranged in the top portion of the inside of the outer tbe, so that it is cooled and condensed. In short, the working fluid is repeatedly evaporated and condensed to transfer the heat as its latent heat thereby intermediate the heat transfer between the hot fluid and the cold fluid. Moreover, the inner tube is positioned in the top of the inside of the outer tube to substantially contact with the inner face of the outer tube so that it directly receives the heat of the hot fluid. Even if the working fluid is not sufficiently fed to the top portion of the inner face of the outer tube, the feed of the heat from the hot to cold fluids is effected through the tube walls to compensate the substantial reduction in the heat transfer area due to shortage of the working liquid.

BRIEF DESCRIPTION OF THE DRAWING

Other objects, features and advantages of the present invention will become apparent from the following description taken in conjunction with the embodiment thereof with reference to the accompanying drawings, in which.

DESCRIPTION OF THE PREFERRED EMBODIMENT

Figure 1:
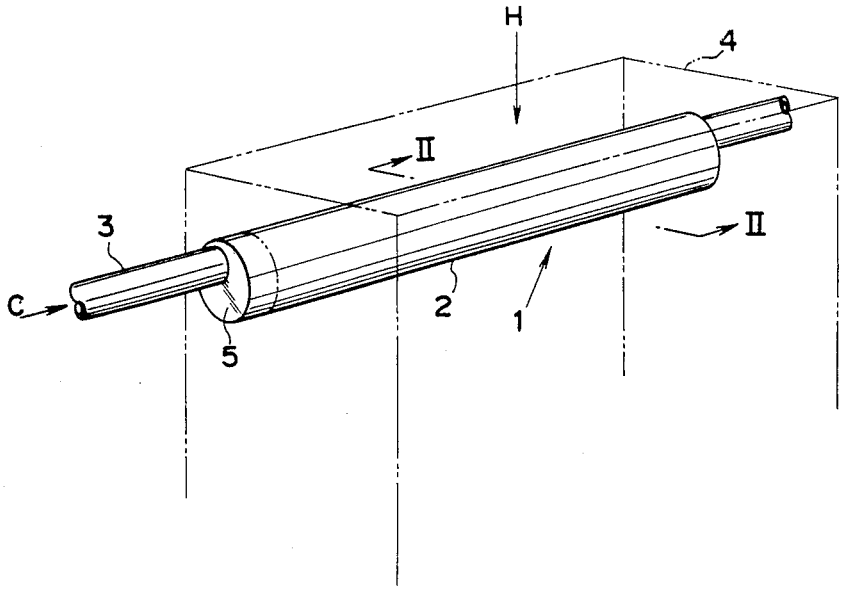
FIG. 1 is a perspective view schematically showing one embodiment of the present invention.
Figure 2:
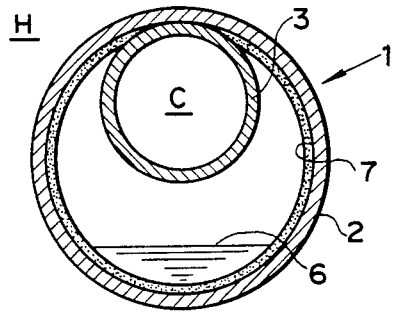
FIG. 2 is a section taken along line II—II of FIG. 1.

As shown in FIGS. 1 and 2, there is provided a heat pipe 1 for heat exchange between a hot fluid H and a cold liquid C. This heat pipe 1 has a dual structure composed of an outer tube 2 and an inner tube 3 inserted in the outer tube 2. Specifically, the outer tube 2 is fixed generally in a horizontal position within a predetermined chamber 4 for letting the hot fluid H flow therethrough. The inner tube 3 is arranged to run within the outer tube 2 in the axial direction and substantially in contact with the inner face of the top of the outer tube 2. These outer and inner tubes 2 and 3 are united together into an integral structure by means of end plates 5 which are fitted at the two ends of the outer tube 2, thus confining a gas-tight space between the inner circumference of the outer tube 2 and the outer circumference of the inner tube 3. This sealed space is prepared to form part of the heat pipe 1 by evacuating it to scavenge non-condensible gases such as air, by subsequently confining such a condensible working fluid 6, e.g., mercury which will evaporate and condense at a target temperature, and by lining the inner circumference of the outer tube, if necessary, with a wick 7 having a capillary action such as a wire gauze.

The heat exchanger thus constructed is used in the case of a heat exchange between the hot fluid H such as molten metallic sodium and the cold fluid such as water so that the outer tube 2 is exposed to the hot fluid H to cause a heat input through its wall. As a result, the working fluid 6 within the heat pipe 1 is evaporated with the heat of the hot fluid H so that its vapor flows in a portion under a lower pressure, i.e., in that top portion of the outer tube 2, which is cooled with the water flowing through the inner tube 3, until it comes into contact with the inner tube 3. Since this inner tube 3 is cooled to a lower temperature by the cold fluid or water C flowing therethrough, the vapor of the working fluid has its heat robbed by the cold fluid C of the inner tube 3 so that it is condensed. In other words, the heat of the hot fluid H is carried as a latent heat of the working fluid 6 and transferred to the cold fluid C so that the heat exchange between the hot fluid H and the cold fluid C is intermediated by the working fluid 6. This evaporation of the working fluid 6 occurs over a wide range of the inner circumference of the outer tube 2 because the working fluid 6 is distributed over the inner circumference of the outer tube 2 by the wick 7. In this heat pipe 1, the inner tube 3 is arranged to substantially contact with the top portion of the inner circumference of the outer tube 2 so that the heat input from the hot fluid H is transferred directly to the cold fluid C through the walls of the outer tube 2 and the inner tube 3. The upper portion of the inner circumference of the outer tube 2 having substantial contact with the inner tube 3 is spaced far from the pool of the working fluid 6 to provide such a portion as will become short of the working fluid because the fluid is evaporated midway even if it is sucked up by the wick. Thus, the portion cannot expect much from the heat exchange through the working fluid 6. Despite of this fact, however, the aforementioned direct heat change through the tube walls takes place to compensate the insufficiency of the heat exchange due to the shortage of the working liquid so that the overall efficiency of the heat exchange is enhanced.

Only one heat pipe 1 is used in the embodiment thus far described, to which the present invention should not be limited, but a plurality of dual-tube heat pipes may be connected in series or parallel. In an alternative of the present invention, the wick may be omitted from the heat pipe.

As has been described hereinbefore, according to the heat exchanger of the present invention, the inner tube for the cold fluid is arranged to substantially contact with that top portion of the inner circumference of the outer tube, which is liable to dry out due to shortage of the feed of the working fluid. This enables the insufficiency of the heat transfer due to the shortage of the working fluid to be compensated by the heat exchange through the tube walls. As a result, the heat exchanging efficiency can be maintained at a high level even if the feed of the working liquid is insufficient. The present invention is effective especially in case the heat flow is so high that the feeding rate of the working fluid cannot follow the evaporation rate of the same. Thus, the present invention can be suitably used in a steam generator for a fast breeder reactor, in which the heat exchange is performed between molten metallic sodium and water.

What is claimed is:

1. A dual-tube heat pipe type heat exchanger comprising:

a chamber in which a hot fluid flows;

an outer tube fixed in a horizontal position in the chamber;

an inner tube for letting a cold fluid flow therethrough inserted in said outer tube and radially offset upward to contact with a top portion of an inner face of said outer tube;

end plates fitted at two opposite ends of the outer tube to confine a gas-tight space between the inner circumference of said outer tube and the outer circumference of said inner tube; and a working fluid in said gas-tight space for transferring heat as a latent heat by repeating evaporations and condensations.

2. A dual-tube heat pipe type heat exchanger according to claim 1, wherein said working fluid is mercury.

3. A dual-tube heat pipe type heat exchanger according to claim 1, wherein said hot fluid is molten metallic sodium whereas said cold fluid is water.

4. A dual-tube heat pipe type heat exchanger according to claim 1, wherein said heat pipe further comprises a wick having a capillary action and extending over the inner circumference of said outer tube while leaving the contacting portions of said outer tube and said inner tube.

5. A dual-tube heat pipe type heat exchanger according to claim 4, wherein said wick is made of wire gauze.

* * * * *